US008717274B2

(12) United States Patent
Lin et al.

(10) Patent No.: US 8,717,274 B2
(45) Date of Patent: May 6, 2014

(54) DRIVING CIRCUIT AND METHOD FOR DRIVING A DISPLAY

(75) Inventors: Yung-Shu Lin, Hsinchu (TW); Chun-Fan Chung, Hsinchu (TW); Yu-Hsi Ho, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 473 days.

(21) Appl. No.: 12/900,151

(22) Filed: Oct. 7, 2010

(65) Prior Publication Data

US 2012/0086677 A1 Apr. 12, 2012

(51) Int. Cl.
*G09G 3/36* (2006.01)

(52) U.S. Cl.
USPC ..... 345/99; 345/100

(58) Field of Classification Search
USPC ..... 345/100, 87, 98, 99
See application file for complete search history.

(56) References Cited

U.S. PATENT DOCUMENTS 6,232,941 B1 5/2001 Ode et al.
6,909,414 B2 6/2005 Tsuchi et al.
7,006,072 B2 * 2/2006 Ahn ..... 345/103
7,030,844 B2 4/2006 Kang et al.
7,667,675 B2 * 2/2010 Kyeong et al. ..... 345/87
2003/0090451 A1 5/2003 Ahn
2003/0193424 A1 * 10/2003 Chiang ..... 341/100
2005/0156862 A1 * 7/2005 Hirayama et al. ..... 345/100
2008/0238906 A1 10/2008 Kwon
2011/0109816 A1 5/2011 Kim et al.

FOREIGN PATENT DOCUMENTS

WO 2010002106 A2 1/2010

* cited by examiner

*Primary Examiner* — Chanh Nguyen
*Assistant Examiner* — Roy Rabindranath
(74) *Attorney, Agent, or Firm* — Morris Manning & Martin, LLP; Tim Tingkang Xia, Esq.

(57) ABSTRACT

In one aspect of the invention, a method for driving a display includes the steps of processing input image signals into pixel signals associated with the pixel matrix and grayscales of the display, generating a polarity control signal POL, and determining transmitting paths of the pixel signals according to the polarity control signal POL, and writing the pixel signals into the pixel matrix of the display along the determined transmitting paths.

12 Claims, 8 Drawing Sheets

DRIVING CIRCUIT AND METHOD FOR DRIVING A DISPLAY

FIELD OF THE INVENTION

The present invention relates generally to a display, and more particularly, to a driving circuit for driving a display configured such that data latching and POL storing are simultaneously performed, thereby reducing the numbers of multiplexors and bus lines used in the driving circuit, and method of driving same.

BACKGROUND OF THE INVENTION

A display panel has a substrate and pixel elements formed thereon. These pixel elements are substantially arranged in the form of a matrix having gate lines in rows and data lines in columns. The display panel is driven by a driving circuit including a gate driver and a source driver. The gate driver generates a plurality of gate signals (scanning signals) sequentially applied to the gate lines for sequentially turning on the pixel elements row-by-row. The source driver generates a plurality of data signals (source signals), i.e., sequentially sampling image signals, simultaneously applied to the data lines in conjunction with the gate signals applied to the gate lines for displaying an image on the panel.

FIG. 8 is a block diagram of a conventional source driver 10 of a display. The source driver 10 includes a shift register (not shown), a first latch array 11, a first multiplexer array 12, a second latch array 13, a level shifter array 14, a digital-to-analog converter (DAC) array 15, a second multiplexer array 16, and an output buffer array 17. The source driver 10 is electrically coupled to a data input processor (data register) 20 having a Mini-LVDS input interface 21 and a Series to Parallel converter 22.

Image signals, LV0, LV1, . . . , RV2, are first received in the Mini-LVDS 21 and processed into a digital image format appropriate to the spatial addressing and the gray scale capabilities of the display, i.e., pixel data signals, having R, G, B components corresponding red, green and blue color signals, respectively. Each color signal is composed of N bits. The pixel data signals are converted from a serial format to a parallel format in the Series to Parallel converter 22, and then outputted to the first latch array 11 via bus lines 23. The shift register sequentially outputs a plurality of enable signals to the first latch array 11. The first and second latch arrays 11 and 13 latch and output the pixel data signal in response to the enable signals. The first multiplexer array 12 having a plurality of MUXs is arranged between the first and second latch arrays 11 and 13 for determining a path of the pixel data signals output from the first latch array 11 to the second latch array 13 in response to a polarity control signal POL from a timing controller (not shown). The level shifter array 14 receives the pixel data signals from the second latch array 13, changes the voltage level of the pixel data signals and then outputs the pixel data signals to the DAC array 15. The DAC array 15 converts the pixel data signals received from the level shifter array 14 into analog pixel signals. The second multiplexer array 16 having a plurality of MUXs outputs the analog pixel signals received from the DAC array 15 to the output buffer array 17 selectively in paths according to the polarity control signal POL. Finally, the output buffer array 17 writes the analog pixel signals (i.e., the image signals) to the panel pixels, for example, liquid crystal cells, for display.

As shown in FIG. 9, the polarity control signal POL has a polarity inverted periodically. It is the periodic polarity inversion of the polarity control signal POL that enables the control of the polarities of the pixel data R, G, and B, through the first and second multiplexer arrays 12 and 16. However, the polarity inversion circuit including the first and second multiplexer arrays 12 and 16 may physically occupy about 3% or more of an area of the source driver on a display panel. The more bits the pixel data R, G and B, the more MUXs in the first and second multiplexer arrays 12 and 16, thereby increasing the complexity and manufacture cost of the source driver.

Therefore, a heretofore unaddressed need exists in the art to address the aforementioned deficiencies and inadequacies.

SUMMARY OF THE INVENTION

In one aspect of the present invention, a driving circuit for driving a display having a plurality of pixels spatially arranged in a matrix form includes an input interface for processing input image signals into digital pixel signals associated with the pixel matrix and grayscales of the display, a timing controller for generating a polarity control signal POL, and a series to parallel converter electrically coupled to the input interface for converting the digital pixel signals from a series format to a parallel format and the timing controller for controlling output paths of the parallel digital pixel signals. The series to parallel converter has a plurality of latches, LATCH, for latching and outputting the parallel digital pixel signals, and a plurality of multiplexors, MUX, electrically coupled to the plurality of latches LATCH for receiving the parallel digital pixel signals therefrom and controlled by the polarity control signal POL for selecting the output paths of the parallel digital pixel signals. In one embodiment, the plurality of latches LATCH has six latches LATCH, and the plurality of multiplexors MUX has six multiplexors MUX. The polarity control signal POL has a low state, POL(−), and a high state, POL(+), and is alternately in the low and high states POL(−) and POL(+). The input interface comprises a Mini-LVDS input interface.

The driving circuit also includes a source driver electrically coupled to the series to parallel converter and the timing controller for converting the digital pixel signals into analog pixel signals and writing the analog pixel signals into the pixel matrix according to the polarity control signal POL.

In one embodiment, the source driver comprises a first latch array having a plurality of latches, Latch1, electrically coupled to the plurality of multiplexors MUX through bus lines for latching the digital pixel signals receiving from the plurality of multiplexors MUX and simultaneously outputting latched digital pixel signals, a second latch array having a plurality of latches, Latch2, electrically coupled to the first latch array for latching the digital pixel signals receiving from the first latch array and simultaneously outputting latched digital pixel signals, a level shifter array having a plurality of level shifters, Level_Shifter, electrically coupled to the second latch array for changing the voltage level of the digital pixel signals received therefrom, a digital-analog converter (DAC) array having a plurality of alternately located positive DACs, PDAC, and negative DACs, NDAC, electrically coupled to the level shifter array for converting the digital pixel signals received therefrom into analog pixel signals, a multiplexor array electrically coupled to the DAC array for receiving the analog pixel signals therefrom, and selectively outputting the analog pixel signals according to the polarity control signal POL, and an output buffer array having a plurality of output buffers, Output_Buffer, electrically coupled to the multiplexor array for writing the analog pixel signals received from the multiplexor array into the pixel matrix of the display.

In one embodiment, the transmitting paths of the digital pixel signals from the plurality of latches LATCH to the pixel matrix of the display are determined according to the polarity control signal POL before they are latched in the first latch array.

In another aspect of the present invention, a driving circuit for driving a display having a plurality of pixels spatially arranged in a matrix form has an input interface for processing input image signals into pixel signals associated with the pixel matrix and grayscales of the display, a timing controller for generating a polarity control signal POL, a pair of multiplexors, MUX, electrically coupled to the input interface for receiving the pixel signals therefrom and controlled by the polarity control signal POL for selecting transmitting paths of the parallel pixel signals, a data register electrically coupled to the pair of multiplexors MUX for stored the pixel signals including its transmitting paths determined by the polarity control signal POL, and a source driver having a latch array electrically coupled to the data register for receiving the stored pixel signals therefrom, the source driver configured to write the stored pixel signals into the pixel matrix according to the polarity control signal POL.

The polarity control signal POL has a low state, POL(−), and a high state, POL(+), and is alternately in the low and high states POL(−) and POL(+).

In one embodiment, the data register comprises a series to parallel converter. The input interface comprises a pair of Mini-LVDS input interfaces.

In one embodiment, the source driver further includes a shift register electrically coupled to the first latch array.

In yet another aspect of the present invention, a driving circuit for driving a display having a plurality of pixels spatially arranged in a matrix form includes an input interface for processing input image signals into pixel signals associated with the pixel matrix and grayscales of the display, a timing controller for generating a polarity control signal POL, and a source driver. The source driver has a shift register for generating a plurality of sequential pulses, a pair of multiplexors, MUX, for changing the sequence of the plurality of sequential pulses so as to determine transmitting paths of the pixel signals according to the polarity control signal POL, and a first latch array for latching the pixel signals and its transmitting paths to the pixel matrix according to the polarity control signal POL.

The driving circuit further comprises a series to parallel converter for converting a series format of the pixel signals received from the input interface into a parallel format and outputting the parallel pixel signals to the first latch array.

The polarity control signal POL has a low state, POL(−), and a high state, POL(+), and is alternately in the low and high states POL(−) and POL(+).

In one embodiment, the input interface comprises a Mini-LVDS input interface.

In a further aspect, the present invention relates to a method for driving a display having a plurality of pixels spatially arranged in a matrix form. In one embodiment, the method includes the steps of processing input image signals into pixel signals associated with the pixel matrix and grayscales of the display, generating a polarity control signal POL, and determining transmitting paths of the pixel signals according to the polarity control signal POL, and writing the pixel signals into the pixel matrix along the determined transmitting paths. The polarity control signal POL has a low state, POL(−), and a high state, POL(+), and is alternately in the low and high states POL(−) and POL(+).

In one embodiment, the determining step is performed with a plurality of latches. Further, the determining step is performed with a series to parallel converter.

The processing step is performed with a Mini-LVDS input interface.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
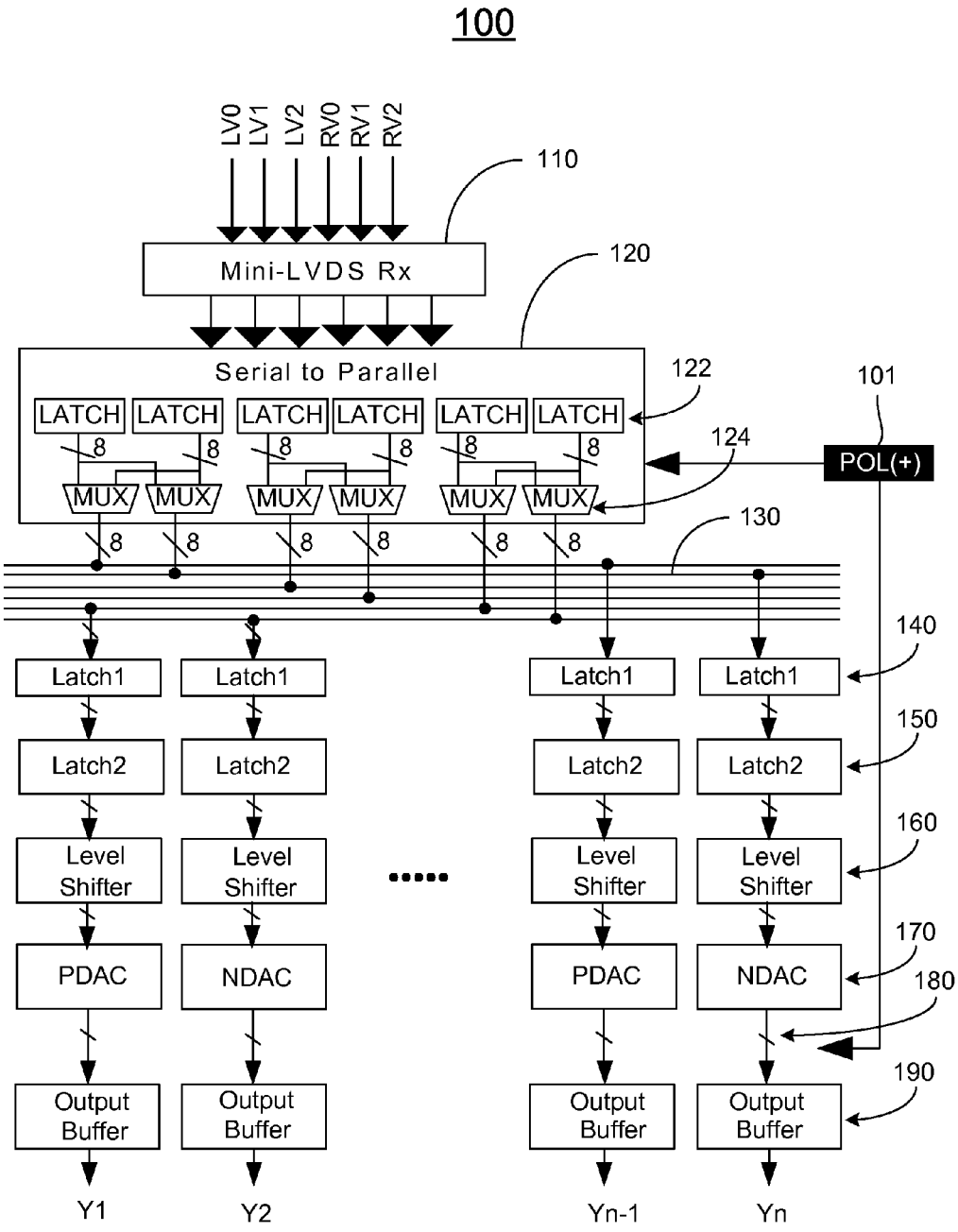
FIG. 1 shows schematically a block diagram of a driving circuit for driving a display for a positive polarity of a control signal according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. As used herein, the singular forms "a", "an" and "the" are intended to include the plural forms as well, unless the context clearly indicates otherwise. As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

The description will be made as to the embodiments of the present invention in conjunction with the accompanying drawings of FIGS. 1-7. In accordance with the purposes of this invention, as embodied and broadly described herein, this invention, in one aspect, relates to a driver for driving an LED backlight with random PWM dimming control, and a method of driving same.

Figure 2:
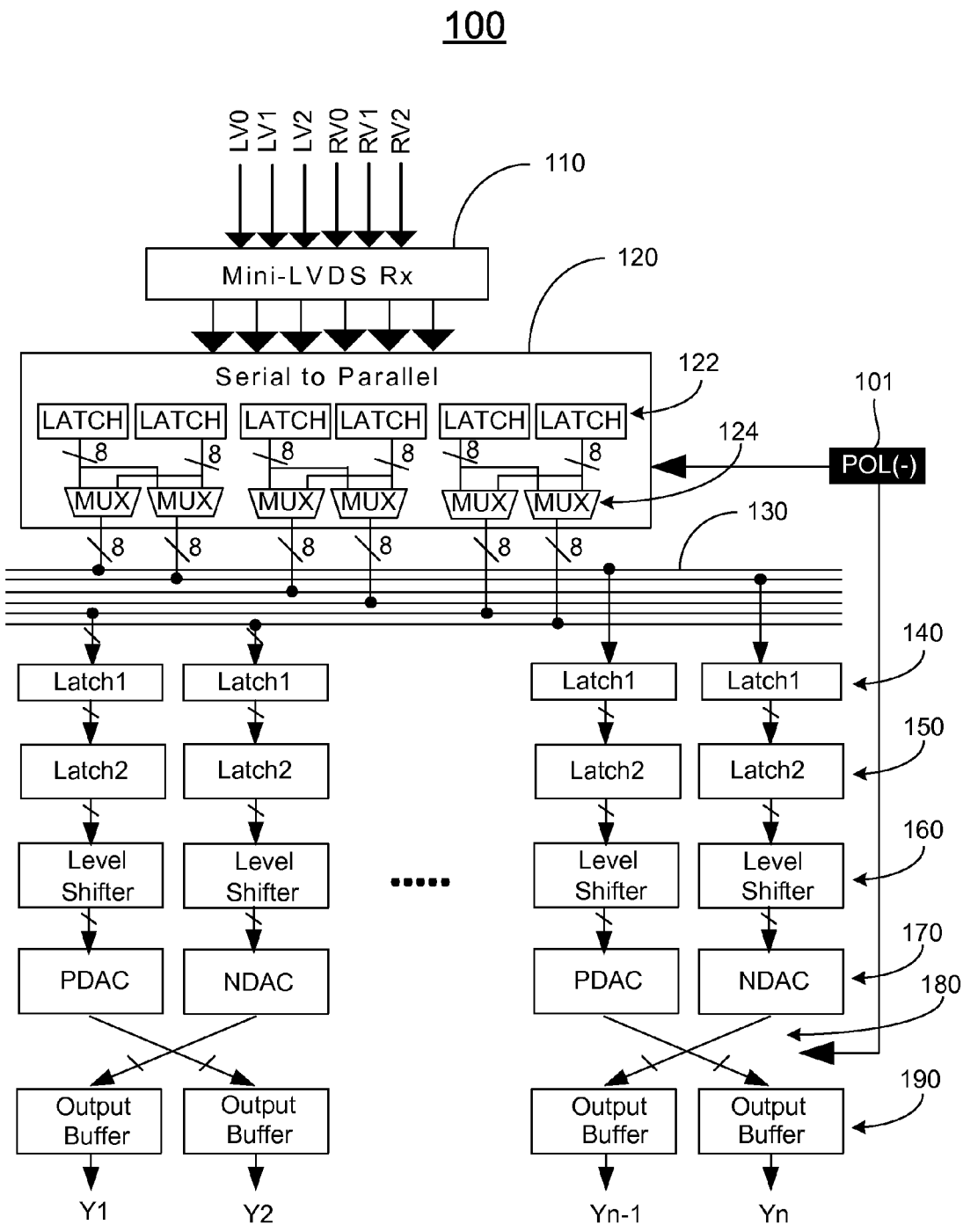
FIG. 2 shows schematically a block diagram of the driving circuit of FIG. 1 for a negative polarity of a control signal.

Referring to FIGS. 1 and 2, a driving circuit 100 for driving a display having a plurality of pixels spatially arranged in a matrix form is shown according to one embodiment of the present invention.

The driving circuit 100 includes an input interface 110, for example, a Mini-LVDS Rx, for processing input image signals, LV0, LV1, LV2, RV0, RV1 and RV2, into digital pixel signals associated with the pixel matrix and grayscales of the display. The digital pixel signals have R, G, B components, i.e., three color signals that indicate RED, GREEN, BLUE, respectively. In this exemplary embodiment shown in FIGS. 1 and 2, each color signal has 8 bits. Usually, the digital pixel signals are in a series format.

The driving circuit 100 also includes a timing controller (not shown) for generating a polarity control signal POL 101.

The driving circuit 100 further includes a series to parallel converter 120 electrically coupled to the input interface 110 for converting the digital pixel signals from the series format to a parallel format. The series to parallel converter 120 is also electrically coupled to the timing controller for controlling output/transmitting paths of the parallel digital pixel signals. The series to parallel converter 120 has six latches LATCH 122 for latching and outputting the parallel digital pixel signals, and six multiplexors MUX 124 electrically coupled to the latches LATCH 122 for receiving the parallel digital pixel signals therefrom and controlled by the polarity control signal POL 101 for selecting the output/transmitting paths of the parallel digital pixel signals. The polarity control signal POL has a low state, POL(−), and a high state, POL(+), and is alternately in the low and high states POL(−) and POL(+). The input interface comprises a Mini-LVDS input interface.

Additionally, the driving circuit 100 also includes a source driver electrically coupled to the series to parallel converter 120 and the timing controller for converting the digital pixel signals into analog pixel signals and writing the analog pixel signals into the pixel matrix according to the polarity control signal POL.

Specifically, the source driver has a first latch array 140, a second latch array 150, a level shifter array 160, a DAC array 170, a multiplexor array 180 and an output buffer array 190. The first latch array 140 has a plurality of latches, Latch1, electrically coupled to the six multiplexors MUX 124 through bus lines 130 for latching the digital pixel signals receiving from the multiplexors MUX 122 and simultaneously outputting latched digital pixel signals. The second latch array 150 has a plurality of latches Latch2, electrically coupled to the first latch array 140 for latching the digital pixel signals receiving from the first latch array 140 and simultaneously outputting latched digital pixel signals. The pixel signals output from the first latch array 140 to the second latch array 150 with no need of the polarity control signal POL. The level shifter array 160 has a plurality of level shifters Level_Shifter, electrically coupled to the second latch array 150 for changing the voltage level of the digital pixel signals received therefrom. The DAC array 170 has a plurality of alternately located PDAC and NDAC, electrically coupled to the level shifter array 160 for converting the digital pixel signals received therefrom into analog pixel signals. The multiplexor array 180 is electrically coupled to the DAC array 170 for receiving the analog pixel signals therefrom, and selectively outputting the analog pixel signals according to the polarity control signal POL 101. The output buffer array 190 has a plurality of output buffers Output_Buffer, electrically coupled to the multiplexor array 180 for writing the analog pixel signals received from the multiplexor array 180 into the data lines Y1, Y2, . . . , Yn−1 and Yn of the pixel matrix of the display.

According to the present invention, only six latches LATCH 122 and six multiplexors MUX 124 are utilized in the series to parallel converter 120 to determine the transmitting paths of the digital pixel signals. Further, the transmitting paths of the digital pixel signals from the latches LATCH 122 to the data lines Y1, Y2, . . . , Yn−1 and Yn of the pixel matrix of the display are determined according to the polarity control signal POL before they are latched in the first latch array 140. FIG. 1 is corresponding to a positive polarity POL(+) of the control signal POL 101, while FIG. 2 is corresponding to a negative polarity POL(−) of the control signal POL 101.

Figure 3:
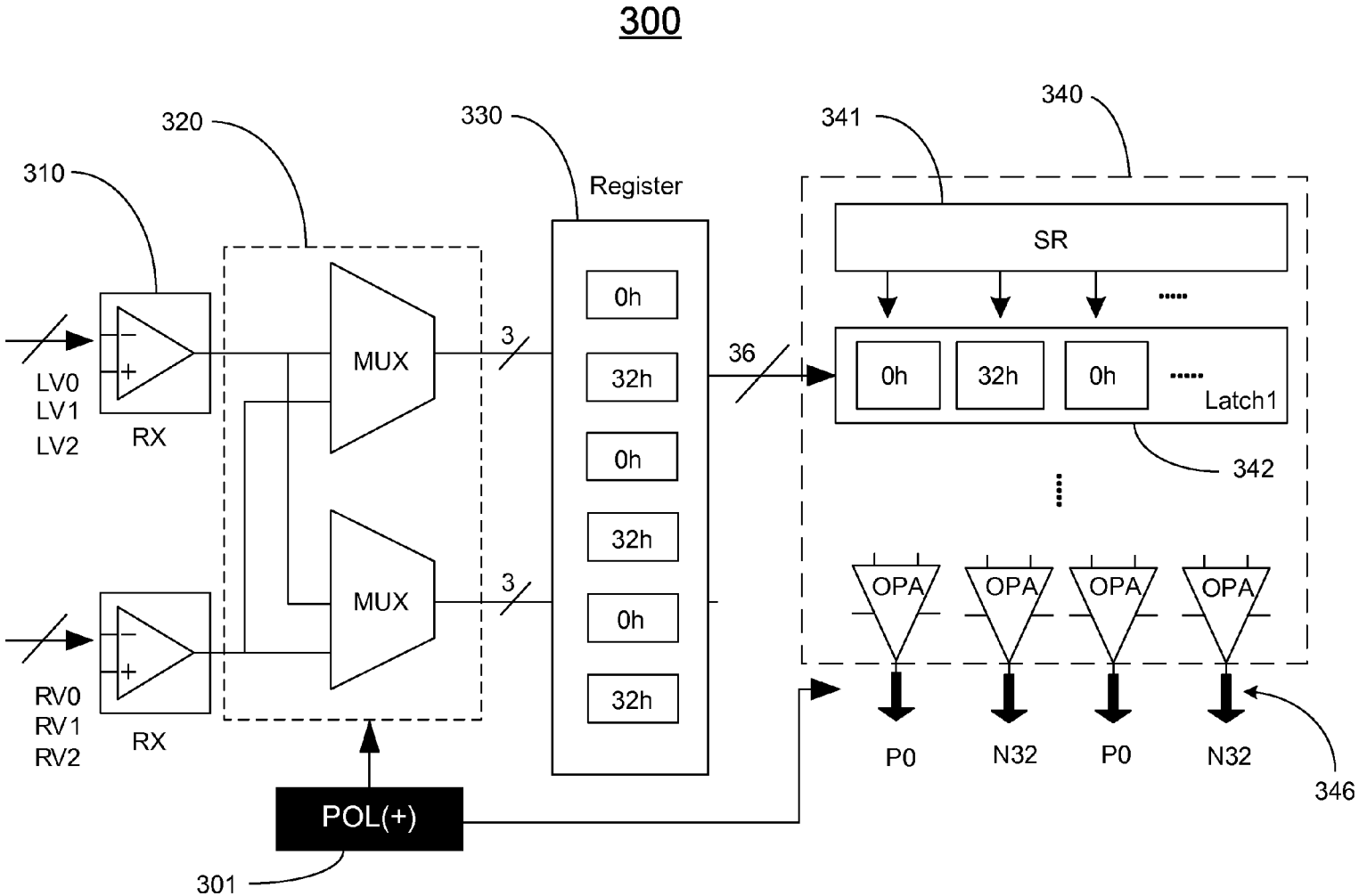
FIG. 3 shows schematically a block diagram of a driving circuit for driving a display for a positive polarity of a control signal according to another embodiment of the present invention.
Figure 4:
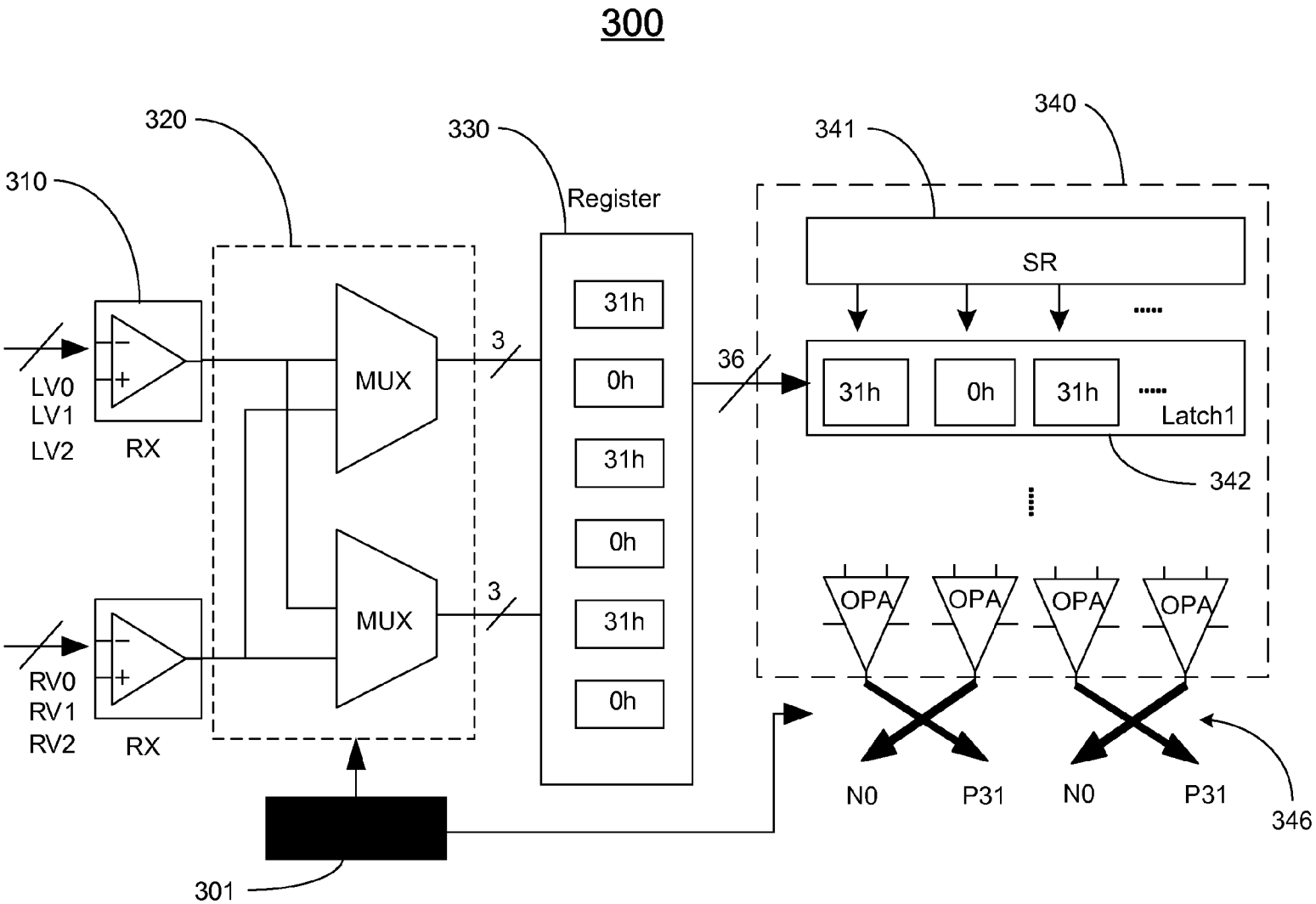
FIG. 4 shows schematically a block diagram of the driving circuit of FIG. 3 for a negative polarity of a control signal.

FIGS. 3 and 4 show a driving circuit 300 for driving a display according to another embodiment of the present invention. The driving circuit 300 includes an input interface 310, a polarity control signal POL 301, a pair of multiplexors MUX 320, a data register 330 and a source driver 340. The polarity control signal POL 301 can have a positive polarity POL(+), as shown in FIG. 3, or a negative polarity POL(−), as shown in FIG. 4.

The input interface 310 has a pair of Mini-LVDS Rx for processing input image signals, LV0, LV1, LV2, and RV0, RV1, RV2, into pixel signals, respectively. The polarity control signal POL 301 is generated by a timing controller.

The pair of multiplexors MUX 320 is electrically coupled to the input interface 310 for receiving the pixel signals therefrom and controlled by the polarity control signal POL 101 for selecting transmitting paths of the parallel pixel signals. The data register 330 is electrically coupled to the pair of multiplexors MUX 320 for stored the pixel signals including its transmitting paths determined by the polarity control signal POL. The data register may include a series to parallel converter.

The source driver 340 has a latch array 342 electrically coupled to the data register 330 for receiving the stored pixel signals therefrom, and a shift register 341 electrically coupled to the first latch array 342. The source driver 340 is configured to write the stored pixel signals into the pixel matrix according to the polarity control signal POL.

In this embodiment, a multiplexer array 346 is adapted for selecting a path of an output of the operational amplifier (OPA) array in response to the polarity control signal POL 301 from the timing controller. For example, FIG. 3 is corresponding to a positive polarity POL(+) of the control signal POL 301, while FIG. 4 is corresponding to a negative polarity POL(−) of the control signal POL 301.

Figure 5:
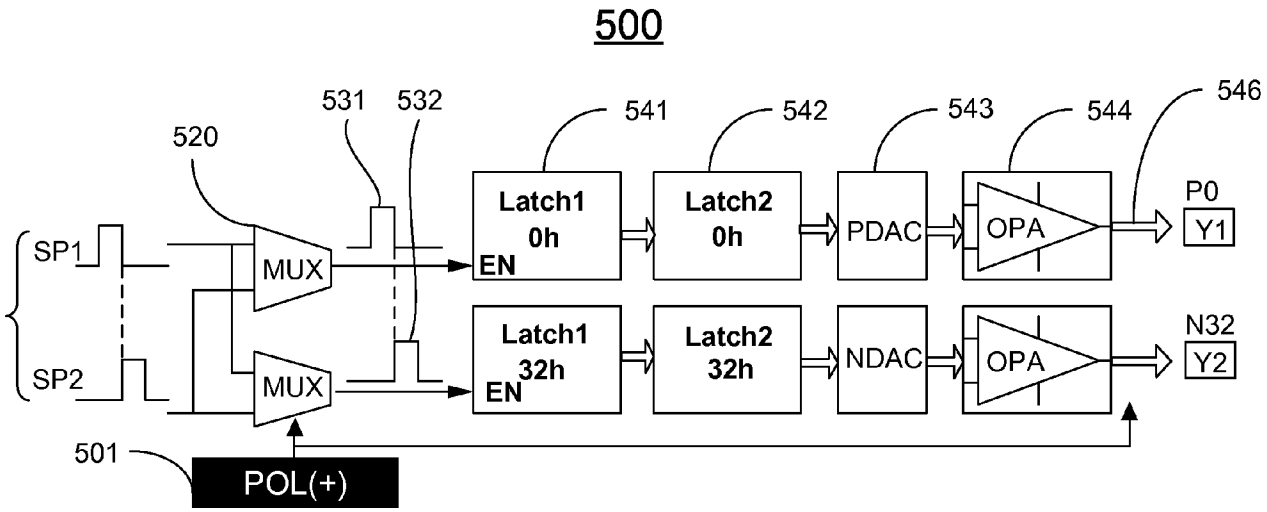
FIG. 5 shows schematically a block diagram of a driving circuit for driving a display for a positive polarity of a control signal according to yet another embodiment of the present invention.
Figure 6:
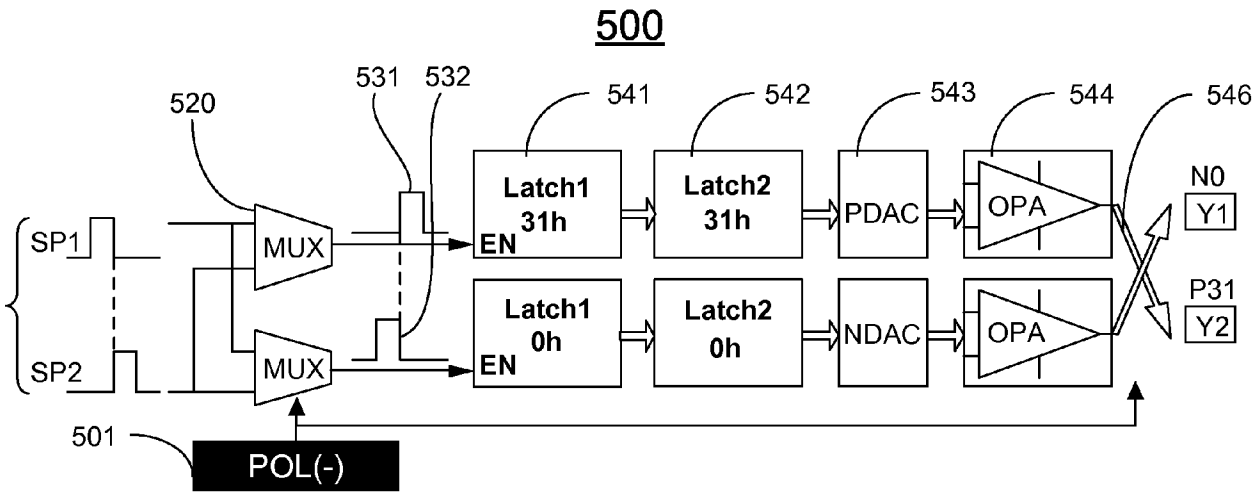
FIG. 6 shows schematically a block diagram of the driving circuit of FIG. 5 for a negative polarity of a control signal.
Figure 7:
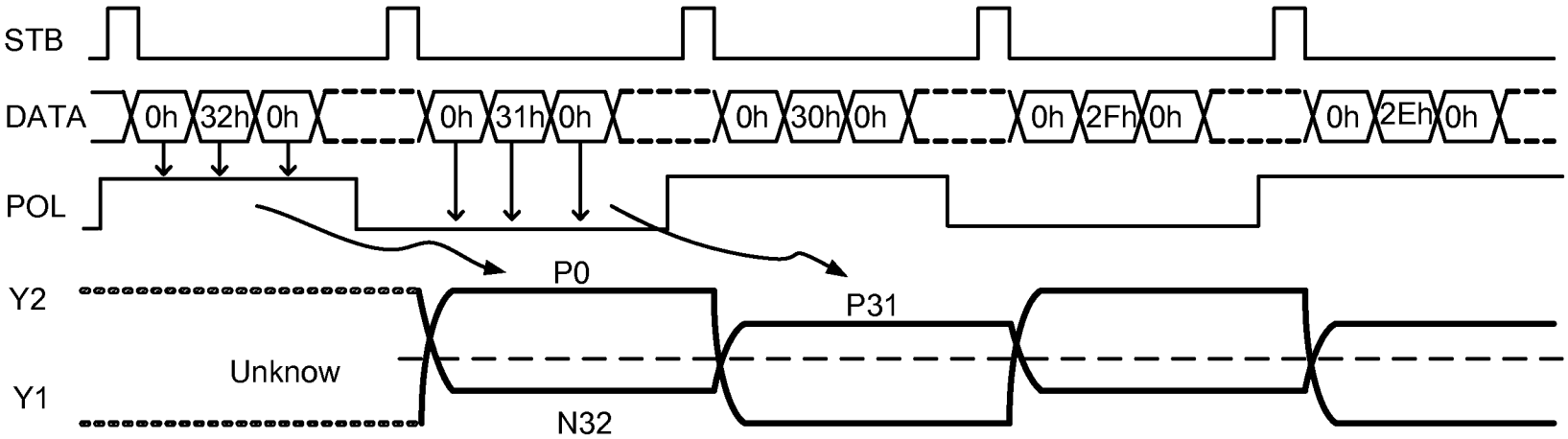
FIG. 7 shows schematically time charts of signals of a driving circuit according to one embodiment of the present invention.
Figure 8:
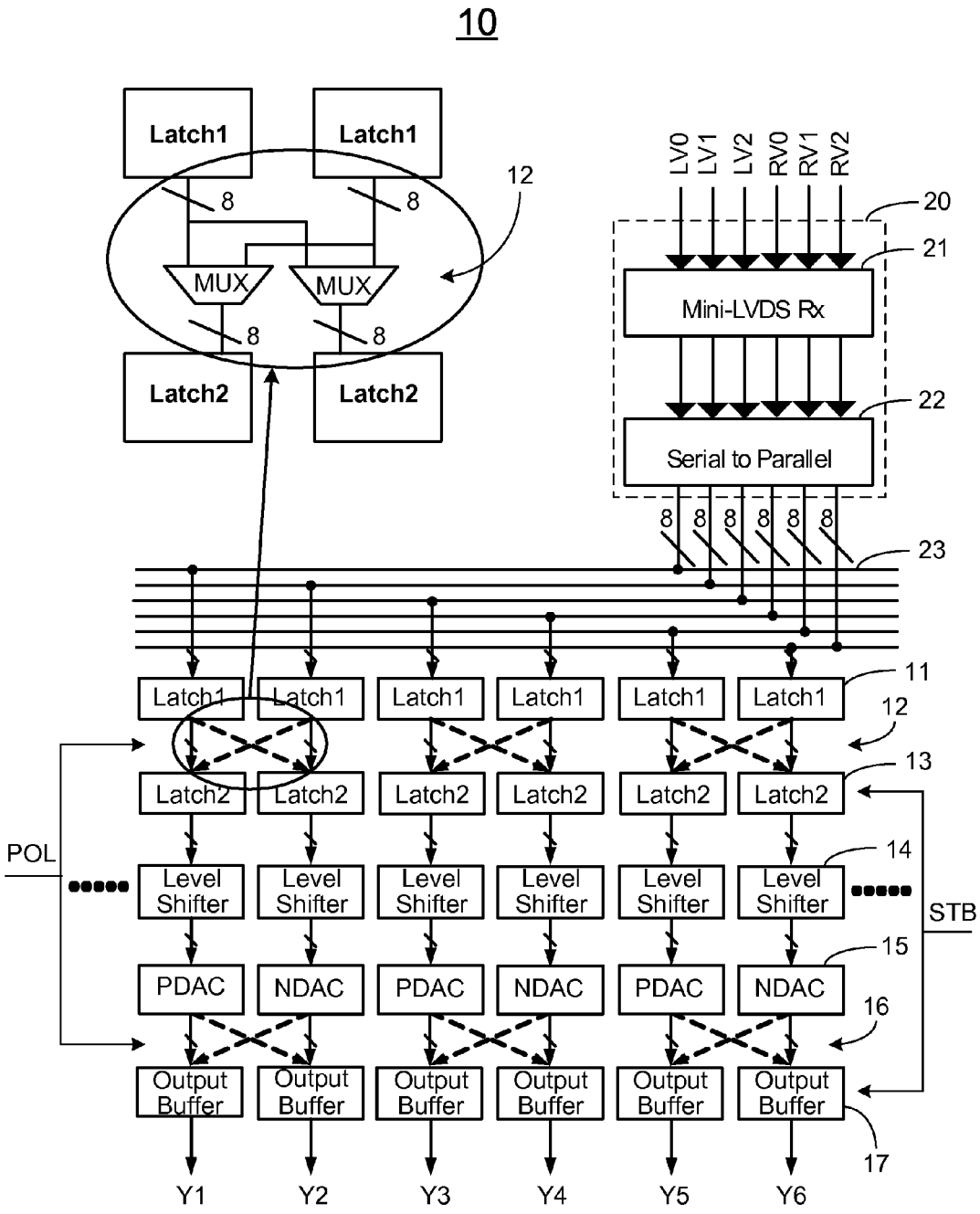
FIG. 8 (Related Art)
FIG. 8 shows schematically a block diagram of a conventional driving circuit.
Figure 9:
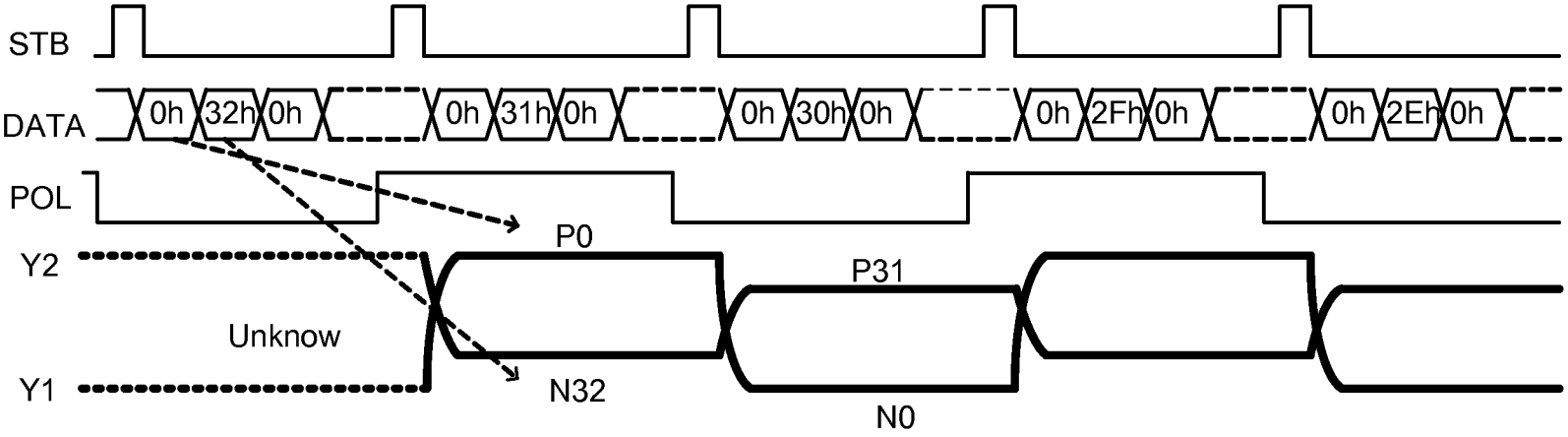
FIG. 9 (Related Art)
FIG. 9 shows schematically time charts of signals of a conventional driving circuit.

FIGS. 5 and 6 show a driving circuit 500 for driving a display according to yet another embodiment of the present invention. The driving circuit 500 includes an input interface (not shown) for processing input image signals into pixel signals associated with the pixel matrix and grayscales of the display, a polarity control signal POL 501, and a source driver. The source driver has a shift register for generating a plurality of sequential pulses, for example, SP1 and SP2, a pair of multiplexors MUX 520 for changing the sequence of SP1 and SP2 so as to transmitting paths of the pixel signals according to the polarity control signal POL 501, and a first latch array 541 for latching the pixel signals and its transmitting paths to the pixel matrix according to the polarity control signal POL. In other words, the data latching and POL storing are simultaneously performed according to the present invention, as shown in FIG. 7. The source driver also has a second latch array 542, a DAC array 543, an OPA array 544 and a multiplexer array 546 adapted for selecting a path of an output of the OPA array 544 in response to the polarity control signal POL 501. There is no polarity control between the first latch array 541 and the second latch array 542

The driving circuit 500 may also include a series to parallel converter for converting a series format of the pixel signals received from the input interface into a parallel format and outputting the parallel pixel signals to the first latch array 541.

Similarly, FIG. 5 is corresponding to a positive polarity POL(+) of the control signal POL 501, while FIG. 6 is corresponding to a negative polarity POL(−) of the control signal POL 501.

One aspect of the present invention relates to a method for driving a display having a pixel matrix. The method includes processing input image signals into pixel signals associated with the pixel matrix and grayscales of the display, generating a polarity control signal POL, and determining transmitting paths of the pixel signals according to the polarity control signal POL, and writing the pixel signals into the pixel matrix along the determined transmitting paths.

The present invention, among other things, recites driving circuits for driving a display that are configured to perform data latching and POL storing simultaneously so that the numbers of multiplexors MUX and bus lines used in the driving circuits are substantially reduced, thereby reducing the chip size of the source driver and the manufacture cost.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A driving circuit for driving a display having a plurality of pixels spatially arranged in a matrix form, comprising:

(a) an input interface for processing input image signals into digital pixel signals associated with the pixel matrix and grayscales of the display;

(b) a timing controller for generating a polarity control signal POL;

(c) a series to parallel converter electrically coupled to the input interface for converting the digital pixel signals from a series format to a parallel format and the timing controller for controlling output paths of the parallel digital pixel signals, comprising:

a plurality of latches, LATCH, for latching and outputting the parallel digital pixel signals, wherein the plurality of latches LATCH has N pairs of latches, wherein each pair of the latches comprises two of the plurality of latches LATCH; and a plurality of multiplexors, MUX, having N pairs of multiplexors, wherein each pair of multiplexors comprises two of the plurality of multiplexors MUX and corresponds to one pair of the latches, and wherein the two multiplexors MUX of each pair of multiplexors are electrically coupled to the two latches LATCH of the corresponding pair of latches for receiving the parallel digital pixel signals therefrom and controlled by the polarity control signal POL for selecting the output paths of the parallel digital pixel signals; and (d) a source driver electrically coupled to the series to parallel converter and the timing controller for converting the digital pixel signals into analog pixel signals and writing the analog pixel signals into the pixel matrix according to the polarity control signal POL, wherein the source driver comprises:

a first latch array having a plurality of latches, Latch1, electrically coupled to the plurality of multiplexors MUX of the series to parallel converter through bus lines for latching the digital pixel signals receiving from the plurality of multiplexors MUX and simultaneously outputting latched digital pixel signals; and a second latch array having a plurality of latches, Latch2, electrically coupled to the first latch array for latching the digital pixel signals receiving from the first latch array and simultaneously outputting latched digital pixel signals.

2. The driving circuit of claim 1, wherein the plurality of latches LATCH has six latches LATCH, and the plurality of multiplexors MUX has six multiplexors MUX.

3. The driving circuit of claim 1, wherein the source driver further comprises:

(a) a level shifter array having a plurality of level shifters, Level_Shifter, electrically coupled to the second latch array for changing the voltage level of the digital pixel signals received therefrom;

(b) a digital-analog converter (DAC) array having a plurality of alternately located positive DACs, PDAC, and negative DACs, NDAC, electrically coupled to the level shifter array for converting the digital pixel signals received therefrom into analog pixel signals;

(c) a multiplexor array electrically coupled to the DAC array for receiving the analog pixel signals therefrom, and selectively outputting the analog pixel signals according to the polarity control signal POL; and (d) an output buffer array having a plurality of output buffers, Output_Buffer, electrically coupled to the multiplexor array for writing the analog pixel signals received from the multiplexor array into the pixel matrix of the display.

4. The driving circuit of claim 3, wherein the transmitting paths of the digital pixel signals from the plurality of latches LATCH to the pixel matrix of the display are determined according to the polarity control signal POL before they are latched in the first latch array.

5. The driving circuit of claim 1, wherein the polarity control signal POL has a low state, POL(−), and a high state, POL(+), and is alternately in the low and high states POL(−) and POL(+).

6. The driving circuit of claim 1, wherein the input interface comprises a Mini-LVDS input interface.

7. A method for driving a display having a plurality of pixels spatially arranged in a matrix form, comprising the steps of:

(a) processing input image signals into pixel signals associated with the pixel matrix and grayscales of the display;

(b) generating a polarity control signal POL;

(c) determining transmitting paths of the pixel signals by a series to parallel converter according to the polarity control signal POL, wherein the series to parallel converter is adapted for converting the pixel signals from a series format to a parallel format and controlling output paths of the parallel pixel signals, and wherein the series to parallel converter comprises:

a plurality of latches, LATCH, for latching and outputting the parallel digital pixel signals, wherein the plurality of latches LATCH has N pairs of latches, wherein each pair of the latches comprises two of the plurality of latches LATCH; and a plurality of multiplexors, MUX, having N pairs of multiplexors, wherein each pair of multiplexors comprises two of the plurality of multiplexors MUX and corresponds to one pair of the latches, and wherein the two multiplexors MUX of each pair of multiplexors are electrically coupled to the two latches LATCH of the corresponding pair of latches for receiving the parallel pixel signals therefrom and controlled by the polarity control signal POL for selecting the output paths of the parallel pixel signals through bus lines; and (d) writing the pixel signals into the pixel matrix along the determined transmitting paths by a source driver, wherein the source driver comprises:

a first latch array having a plurality of latches, Latch1, electrically coupled to the plurality of multiplexors MUX of the series to parallel converter through bus lines for latching the digital pixel signals receiving from the plurality of multiplexors MUX and simultaneously outputting latched digital pixel signals; and a second latch array having a plurality of latches, Latch2, electrically coupled to the first latch array for latching the digital pixel signals receiving from the first latch array and simultaneously outputting latched digital pixel signals.

8. The method of claim 7, wherein the determining step is performed with the series to parallel converter.

9. The method of claim 7, wherein the processing step is performed with a Mini-LVDS input interface.

10. The method of claim 7, wherein the polarity control signal POL has a low state, POL(−), and a high state, POL(+), and is alternately in the low and high states POL(−) and POL(+).

11. The method of claim 7, wherein the source driver further comprises:

(a) a level shifter array having a plurality of level shifters, Level_Shifter, electrically coupled to the second latch array for changing the voltage level of the digital pixel signals received therefrom;

(b) a digital-analog converter (DAC) array having a plurality of alternately located positive DACs, PDAC, and negative DACs, NDAC, electrically coupled to the level shifter array for converting the digital pixel signals received therefrom into analog pixel signals;

(c) a multiplexor array electrically coupled to the DAC array for receiving the analog pixel signals therefrom, and selectively outputting the analog pixel signals according to the polarity control signal POL; and (d) an output buffer array having a plurality of output buffers, Output_Buffer, electrically coupled to the multiplexor array for writing the analog pixel signals received from the multiplexor array into the pixel matrix of the display.

12. The method of claim 11, wherein the determining step is performed before the digital pixel signals are latched in the first latch array.

* * * * *